United States Patent [19]

Akesaka

[11] 4,311,344

[45] Jan. 19, 1982

[54] SHIELD-TYPE TUNNELING MACHINE WITH TOGGLE CONTROLLED BIT PLATES IN CUTTER DISC

[75] Inventor: Toshio Akesaka, Yono, Japan

[73] Assignee: Kabushiki Kaisha Iseki Kaihatsu Koki, Japan

[21] Appl. No.: 140,169

[22] Filed: Apr. 14, 1980

[30] Foreign Application Priority Data

Sep. 12, 1979 [JP] Japan ..... 54-116092

[51] Int. Cl.[3] ..... E21D 9/08

[52] U.S. Cl. ..... 299/33; 299/80; 405/144

[58] Field of Search ..... 299/31, 33, 80, 90; 175/173, 202, 267; 405/144

[56] References Cited

U.S. PATENT DOCUMENTS

| | | | |
|---|---|---|---|
| 1,870,050 | 8/1932 | Hunt | 175/173 X |
| 3,561,223 | 2/1971 | Tabor | 405/144 |
| 3,917,351 | 11/1975 | Pirrie et al. | 299/90 |

*Primary Examiner*—Ernest R. Purser

*Attorney, Agent, or Firm*—Kane, Dalsimer, Kane, Sullivan and Kurucz

[57] ABSTRACT

In a shield-type tunneling machine, a pair of comb-type bit-plates are pivotally supported on a peripheral wall of each cutter slit provided in a cutter disc. In order to adjust a degree of opening of each slit as well as a cutting angle of the bits with respect to the facing, the bit plates are pivotally moved to an open position or a close position for opening or closing each slit, in association with the reciprocating motion of a slide shaft disposed in a hollow drive shaft which rotates the cutter disc.

4 Claims, 11 Drawing Figures

SHIELD-TYPE TUNNELING MACHINE WITH TOGGLE CONTROLLED BIT PLATES IN CUTTER DISC

BACKGROUND OF THE INVENTION

1. Field of the Invention

This invention relates to a shield-type tunneling machine, wherein a degree of opening of slits provided in a cutter disc and a cutting angle of the bits with respect to the facing are freely adjusted.

2. Description of the Prior Art

In the so-called earth-pressure-resisting type, shield tunneling method as disclosed in Japanese Patent Public Disclosure No. 54-22933, a liquid such as sludge is caused to act on the facing ground under a pressure substantially equal to an underground water pressure in the facing, and a degree of opening of respective cutter slit is controlled, so that a cutter head can be pressed on the facing ground under a pressure larger than an active earth pressure of the facing ground but smaller than a passive earth pressure thereof, preventing the collapse of the facing.

In order to carry out such a method, a shield-type tunneling machine must be equipped with a mechanism for adjusting a degree of opening of slits in a cutter disc. A conventional slit-opening adjusting mechanism has been such that, for example, as disclosed in the aforesaid Public Disclosure, bits are slidingly moved from the slits towards or away from the facing, so that, according to a degree of movement of the cutter bits relative to the facing, the opening of respective slits may be adjusted.

Such a mechanism, however, has various drawbacks. One is that an angle of the cutter slits with respect to the ground, namely, a cutting angle, can not be adjusted, with the result of the limited application of the tunneling machine to a soft soil alone. Another drawback is that there is no countermeasure against gravels or the like jammed in gaps between the cutter bits and the slits. A further drawback is resulting in an incomplete sealing between the cutter bits and the slits and the complicated machining process.

SUMMARY OF THE INVENTION

This invention as claimed is intended to provide a shield-type tunneling machine equipped with improved slit-opening adjusting mechanism for adjusting a cutting angle of cutter bits with respect to the facing to an optimum degree.

According to the present invention, a pair of diametrically aligned cutter slits are provided in a cutter disc, and a pair of bit-plates are pivotally supported on the peripheral wall of each cutter slit, the pair of bit-plates being pivotally moved to an open position and a close position by the reciprocating motion of a slide shaft disposed in a hollow drive shaft which rotates the cutter disc. A pair of trunnions and interlocking mechanism constituting means for pivotally moving the bit-plates are provided between the slide shaft and the bit-plates and interconnect the slide shaft and the bit-plates to each other, so that each pair of bit-plates are pivotally moved mutually in the opposite directions in a manner that one bit-plate projects to the facing side and the other bit-plate gets into the shield body, according to a direction of rotation of the cutter disc.

The advantages offered by the present invention are mainly that a cutting angle is freely selected; a cutting resistance between the ground surface and the bits is reduced; there is eliminated a risk of gravels or the like jamming in the cutter slits; wear of the bits is lessened; an improved sealing between the bit-plates and the slits is provided; and simplicity in a manufacturing process is achieved.

BRIEF DESCRIPTION OF THE DRAWINGS

One way of carrying out the invention is described in detail below with reference to drawing which illustrate a preferred embodiment, in which.

DESCRIPTION OF THE PREFERRED EMBODIMENTS

Figure 1:
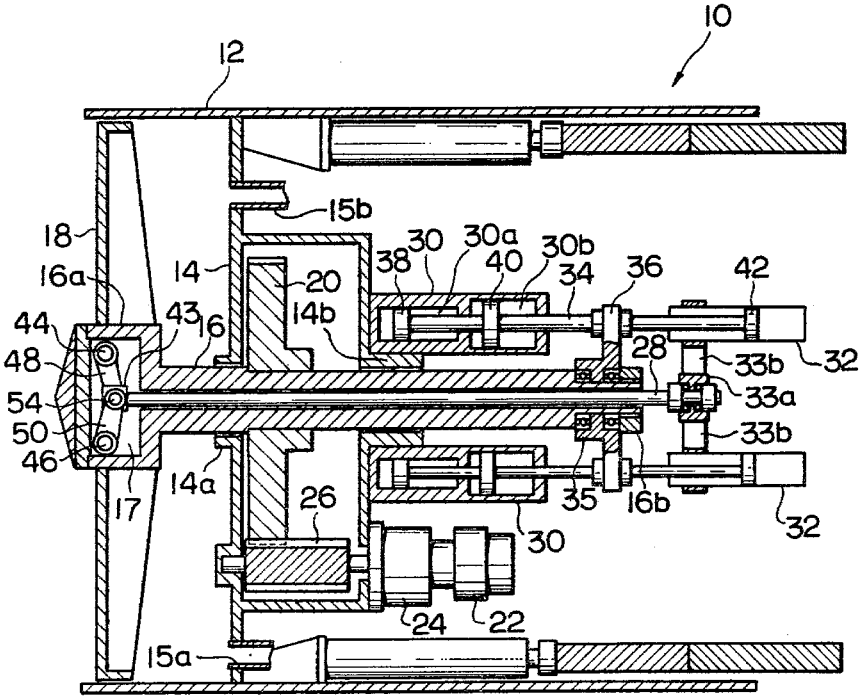
FIG. 1 is a longitudinal cross sectional view of a shield-type tunneling machine according to the present invention.

Referring first to FIG. 1, a shield-type tunneling machine 10 comprises a partition wall or diaphragm 14 fitted in the front portion of a shield body 12 across the body. The partition wall 14 carries substantially at center thereof a hollow rotary shaft 16 rotatably, through the medium of two bearings 14*a* and 14*b*. A dust 15*a* for introducing pressurized fluid to the front of the shield body and a duct 15*b* for discharging muck are attached to the partition wall 14.

A cutter disc 18 positioned at the front of the partition wall 14 is attached to the front end of the rotary shaft 16. The rotary shaft 16 has a drive gear 20 mounted thereon at the rear of the partition wall 14. The drive gear 20 is in mesh with a pinion gear 26 coupled through the medium of a reduction gear 24 to a hydraulic motor 22, so that the drive gear 20 will be driven when the hydraulic motor 22 is run. The hydraulic motor 22 which is a drive source may be replaced by an electric motor (not shown).

A slide shaft 28 is disposed in the hollow rotary shaft 16 and extends through the entire length thereof, with one end thereof projecting into a recess 17 in a diametrically enlarged portion 16*a* of the rotary shaft 16, and with the other end projecting outward of the rear end 16*b* thereof. There is provided a mechanism for rotating the slide shaft 28 integrally with the rotary shaft 16 as well as for causing the slide shaft to reciprocate axially thereof. The slide-shaft-reciprocating mechanism includes plural pairs of hydraulic cylinders 30 and 32.

One pair of hydraulic cylinders 30 are attached to the partition wall 14, and the other pair of hydraulic cylinders 32 are coupled through the medium of the bearing 33*a* and brackets 33*b* to the slide shaft 28, which bearing allows rotation of the slide shaft. A piston rod 34 is fitted in each of the pair of hydraulic cylinders 30, extends therefrom, is slidably supported by a bracket 36 attached through the medium of a bearing 35 to the rotary shaft 16, and eventually fitted into each of the other pair of hydraulic cylinders 32. In respective hydraulic cylinder 30, there are defined two oil chambers 30*a* and 30*b*, in which are lodged two pistons 38 and 40 rigidly secured to the piston rod 34. In respective hydraulic cylinders 32, there is provided a piston 42 attached to the end of the piston rod 34.

Figure 2:
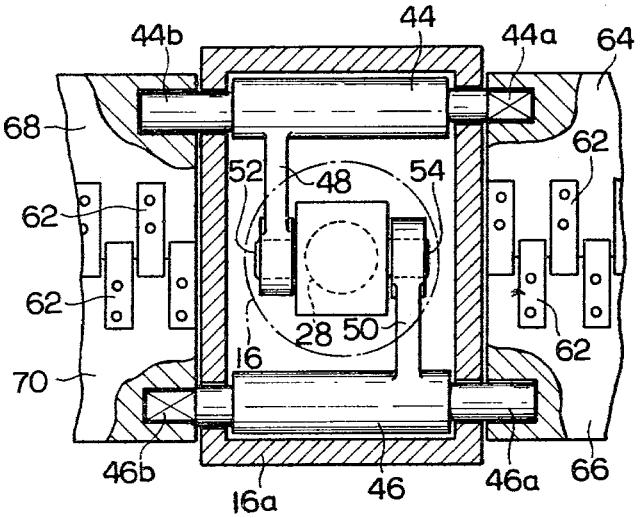
FIG. 2 is a fragmentary cross sectional view of a cutter disc.

A rectangular block 43 is attached to the front end of the slide shaft 28. Arms 48 and 50 of a pair of trunnions 44 disposed in the diametrically enlarged portion 16*a* of the rotary shaft 16 are pivotally supported by pins 52 (FIG. 2) on the opposite sides of the block 43 attached to the front end of the slide shaft.

Figure 3:
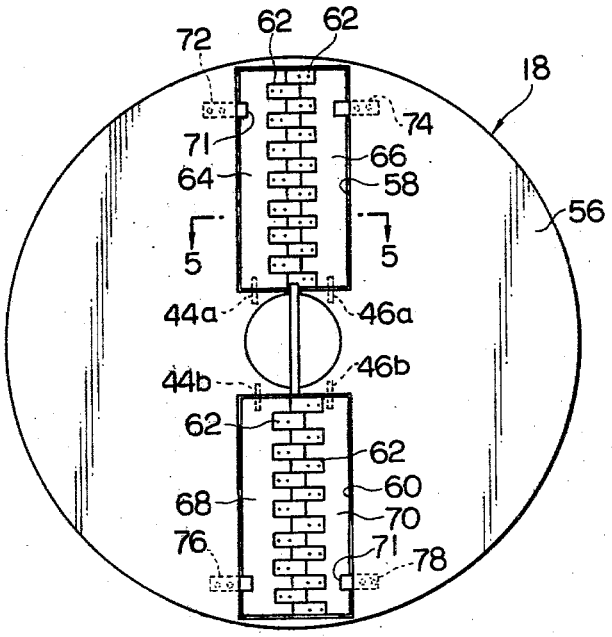
FIG. 3 is an elevational view of the cutter disc.

The cutter disc 18 attached to the front end of the rotary shaft 16 in the diametrically enlarged portion 16*a* thereof presents a circular cross section, as seen in FIG. 3. A surface plate 56 is provided with a first cutter slit 58 and a second cutter slit 60 which are diametrically aligned with each other. One ends 44*a* and 46*a* of the first and second trunnions 44 and 46 extend into the first cutter slit 58, and the other ends 44*b* and 46*b* thereof extend into the second cutter slit 60.

Figure 4:
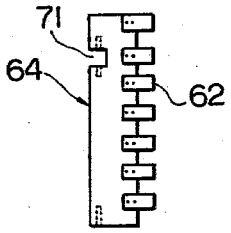
FIG. 4 is a plan view of a comb-type bit-plate.

A slit-opening member consisting of a pair of comb-type bit-plates is disposed in each of the cutter slits. More in detail, a pair of elongated bit-plates 64 and 66, each having a plurality of equally spaced bits 62 attached thereto and presenting a comb-shape as shown in FIG. 4, are disposed in the first cutter slit 58 in a manner that a series of bits of one bit-plate 64 are in mesh with a series of bits of the other bit-plate 66. In FIG. 3, the cutter slit 58 is shown as being completely closed. Likewise, a second slit-opening member consisting of a pair of bit-plates 68 and 70 is disposed within the second cutter slit 60. Respective bit-plates are pivotally supported on the surface plate 56 in a manner to effect an angular rotation, in order to adjust a degree of opening of respective cutter slits and select a proper cutting angle. More in detail, respective bit-plates are coupled by pins to brackets 72,74,76 and 78, respectively, one ends of which are attached to the surface plate 56, and the other ends of which are fitted in cuts 71 provided in respective bit-plates.

Turning back to FIG. 2, one end 44*a* of the trunnion 44 presents a rectangular cross section and is coupled to the bit-plate 64 of the first slit-opening member so as to rotate integrally therewith. One end 46*a* of the trunnion 46 presents a circular cross section and pivotally movably supports the bit-plate 66 of the first slit-opening member.

Figure 5:
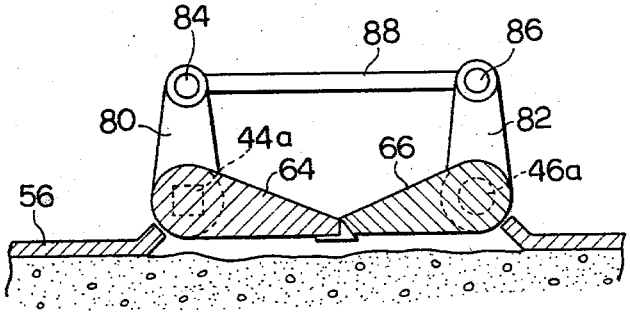
FIG. 5 is a cross-sectional view taken along the line 5—5 of FIG. 3.

The other end 44*b* of the trunnion 44 presents a circular cross section and pivotally movably supports the bit-plate 68 of the second slit-opening member. The other end 46*b* of the trunnion 46 presents a rectangular cross section and is coupled to the bit-plate 70 of the second slit-opening member so as to rotate integrally therewith. As seen in FIG. 5, an interlocking mechanism is provided across the pair of bit-plates 64 and 66, the interlocking mechanism interconnecting the pair of bit-plates with each other and causing these bit-plates to pivotally move mutually in opposite directions, so that when one bit-plate is turned to the exterior of the cutter slit, namely, outward of the surface plate 56 which is on the facing side, then the other bit-plate is turned inward of the slit, namely, inward of the surface plate. The interlocking mechanism comprises an arm member 80 attached at one end to the bit-plate 64; an arm member 82 attached at one end to the bit-plate 66, both arm members extending upright from the axes of the trunnions 44 and 46, when the bit-plates 64 and 66 assume a fully closed position; and a rod 88 pivotally secured by pins 84 and 86 to the other ends of both arm members.

Another interlocking mechanism in provided for the bit-plates 68 and 70 which constitute the second slit-opening member.

Figure 6A:
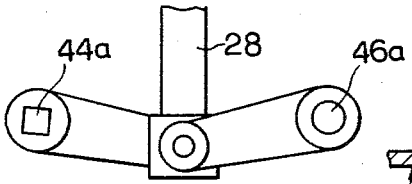
FIGS. 6(*a*), (*b*), 7(*a*), (*b*) and 8(*a*), (*b*) illustrate the relationship between the sliding movement of a slide shaft and the pivotal movement of the bit-plates to an open close positions, respectively.
Figure 6B:
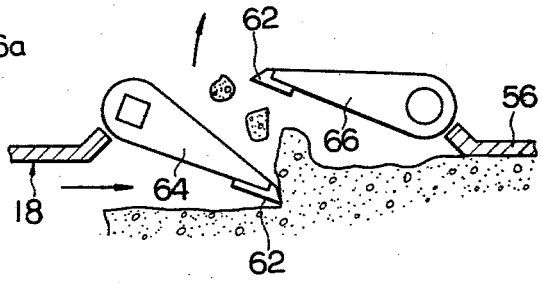
Figure 7A:
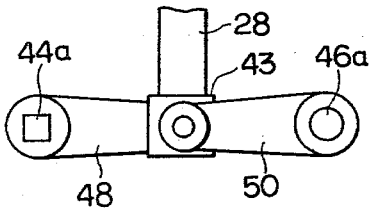
Figure 7B:
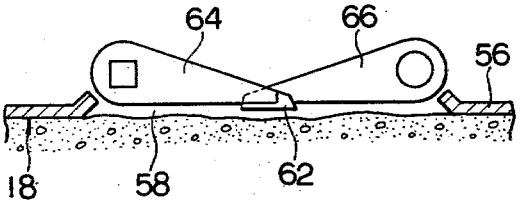
Figure 8A:
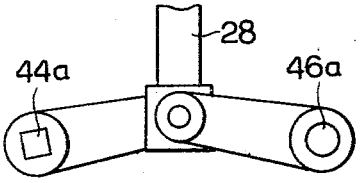
Figure 8B:
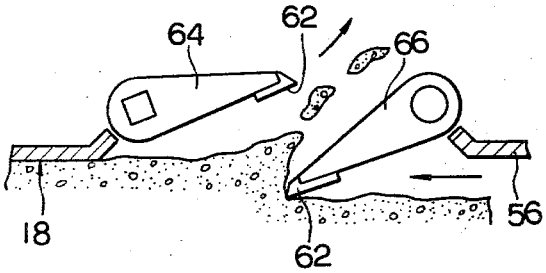

By the cooperation of the pair of trunnions 44 and 46 for transmitting a rotational force to one bit-plates 64 and 70 alone of the pairs of bit-plates with the interlocking mechanism for pivotally moving respective pairs of bit-plates 64,66 or 68,70 in opposite directions, the operations of the bit-plates as shown in FIGS. 6,7 and 8 accomplished.

Referring to FIGS. 7(*a*) and 7(*b*), showing the bit-plates in the fully close condition, which correspond to FIGS. 3 and 5, the slide shaft 28 assumes a home position, and the cutter slit 58 is maintained in a fully close condition by the bit-plates 64 and 66.

Where it is desired to cut the natural ground by rotating the cutter disc 18 clockwise, as viewed from the facing side, the slide shaft 28 is slidingly moved from the position shown in FIG. 7(*a*) downward as viewed in FIG. 7(*a*) (to the left in FIG. 1). The length of sliding movement of the slide shaft 28 is determined by a cutting angle of the bits which is selected according to the nature of the soil of the facing ground. As the trunnion 44 is rotated by the sliding movement of the slide shaft 28, the bit-plate 64 is pivotally moved outward, and the bit-plate 66 is pivotally moved in a direction opposite thereto, namely, inward of the slit.

Where it is desired to cut the natural ground by rotating the cutter disc 18 counterclockwise as viewed from the facing side, the slide shaft 28 is slidingly moved from its home position [FIG. 7(*a*)] in an opposite direction to that of the former case, namely, upward in FIG. 8(*a*) (to the right in FIG. 1). As the trunnion 44 is rotated by the sliding motion of the slide shaft 28, the bit-plate 64 is pivotally moved in the same direction as the direction of shift of the slide shaft 28, namely, inward, and the other bit-plate 66 is pivotally moved by means of the interlocking mechanism in an opposite direction to the direction of movement of the bit-plate 28, namely, outward of the slit or toward the facing. A predetermined cutting angle is thus obtained, and the bits 62 are used for cutting the soil at the cutting angle thus obtained.

In the foregoing, description has been given to the operation of one pair of bit-plates 64 and 66 constituting the first slit-opening member, which is caused by the sliding movement of the slide shaft 28. The other pair of bit-plates 68 and 70 constituting the second slit-opening member operate in like manner as described above, with the exception that the bit-plate 70 is pivotally moved with rotation of the trunnion 46, and the bit-plate 68 is pivotally moved in association with the pivotal movement to the open position or the close position, of the bit-plate 70. Therefore, when the cutter disc 18 is rotated clockwise, the bit-plate 64 is pivotally moved outward of the slit and at the same time, the bit-plate 70 positioned catercorner to the bit-plate 64 (FIG. 3) is pivotally moved outward of the slit. When the cutter disc 18 is rotated counterclockwise, the bit-plate 66 is turned outward of the slit as well as the bit-plate 68 positioned catercorner to the bit-plate 66 is pivotally moved outward thereof in like manner.

As can be seen from the foregoing, respective slit-opening member is composed of a pair of comb-type bit-plates, and a cutting angle of the comb-type bit-plate with respect to the facing is freely adjusted by selecting the length of sliding movement of the slide shaft, irrespective of a direction of rotation of the cutter disc, so that the shield-type tunneling machine can find a wide application to either a soft soil or a hard soil, as well the tunneling work is facilitated.

If one bit-plate of the pair of bit-plates is pivotally moved towards the facing side, then the other bit-plate is pivotally moved in a direction opposite thereto, such that resistance between the natural ground and the bits is greatly reduced, and the pivotal movement to the open and close positions, of the pair of bit-plates eliminates a risk or gravels or the like jamming in the slits.

Since a pair of bit-plates are provided in each cutter slit, and a direction of rotation of the cutter disc is properly reversed, the bits no longer suffer from local wear, with the result of the extended service life of the bits.

Furthermore, since the cutter slits are opened or closed by the pivotal movement, rather than the sliding motion, of the bit-plates, the improved sealing is provided between the bit-plates and the slits, as well as the simplicity in manufacture is provided. The cutter disc and the associated members may be availed for a shield-type tunneling machine of a large diameter.

When the cutter disc is stopped, the bit-plates always assume the fully close positions, such that the collapse of the ground is prevented, coupled with the improved sealing property. The present invention may be thus applied to an earth-pressure-resisting type shield tunneling machine.

What is claimed is:

1. A shield-type tunneling machine comprising a shield body;

a partition wall fitted across said shield body;

a hollow rotary shaft rotatably supported by said partition wall;

a cutter disc attached to the front end of said rotary shaft at the front of said partition wall and including first and second cutter slits provided therein in diametrical alignment with each other;

a slide shaft disposed within said hollow rotary shaft rotably integrally therewith;

said cutter disc including a first slit-opening member comprising a pair of comb-type bit-plates disposed in said first cutter slit and a second slit-opening member comprising a pair of comb-type bit-plates disposed in said second cutter slit;

means for interconnecting said slide shaft to said respective slit-opening members and for pivotally moving said slit-opening members to thereby open or close said respective cutter slits when said slide shaft is slidingly moved in the axial direction thereof;

said means for pivotally moving said slit-opening members comprising first and second trunnions having arms pivoted to the opposite sides of the front end of said slide shaft, and extending at first ends thereof into said first slit and at the other ends into said second slit, and an interlocking mechanism interconnecting said first and second trunnions with each other and rotating said trunnions mutually in opposite directions when said slide shaft is caused to reciprocate, one end of said first trunnion being secured to one of the bit-plates of said first slit-opening member, and one end of said second trunnion being pivoted to the other bit-plate of said first slit-opening member, the other end of said first trunnion being pivoted to one of the bit-plates of said second slit-opening member, and the other end of said second trunnion being secured to the other bit-plate of said second slit-opening member.

2. A shield-type tunneling machine as claimed in claim 1, in which said respective slit-opening members are formed by arranging said pair of comb-type bit-plates in a manner that the bits of one bit-plate are in mesh with the bits of the other bit-plate.

3. A shield-type tunneling machine as defined in claim 1 including a first duct for introducing pressurized fluid to the front of said shield body and a second duct for discharging muck, said first and second ducts attached to said partition wall.

4. A shield-type tunneling machine as defined in claim 1 wherein said slide shaft extends through the entire length of said hollow rotary shaft, the front end of said slide shaft projecting into a recess of a diametrically enlarged portion of said hollow rotary shaft, a block attached to the front end of said slide shaft, first and second arms pivotally supported on opposite sides of said block, said arms connecting said block with said first and second trunnions.

* * * * *